United States Patent [19]

Berliner

[11] 4,060,496

[45] Nov. 29, 1977

[54] STAINLESS STEEL CLEANER

[75] Inventor: Julius F. T. Berliner, Chicago, Ill.

[73] Assignee: Burnishine Products Inc., Skokie, Ill.

[21] Appl. No.: 681,716

[22] Filed: Apr. 29, 1976

[51] Int. Cl.[2] ..... C23G 5/02; C11D 7/50

[52] U.S. Cl. ..... 252/171; 252/118; 252/79.1; 252/DIG. 10; 252/162; 252/170; 252/122; 252/143; 134/3; 134/34

[58] Field of Search ..... 252/170, 171, 79.1, 252/DIG. 10, 162, 143, 122, 118, 126; 134/3, 34

[56] References Cited

U.S. PATENT DOCUMENTS

| | | | |
|---|---|---|---|
| 2,162,656 | 6/1939 | Warrington | 252/170 X |
| 2,583,165 | 1/1952 | Campbell | 252/118 |
| 3,528,922 | 9/1970 | Wagner, Jr. | 252/171 X |
| 3,642,644 | 2/1972 | Grete et al. | 252/170 X |
| 3,822,213 | 7/1974 | Johnson | 252/170 X |

*Primary Examiner*—Mayer Weinblatt
*Attorney, Agent, or Firm*—Rummler & Snow

[57] ABSTRACT

Stable, essentially non-toxic, clear cleaning solutions for a variety of metals, especially stainless steel, are disclosed characterized by exhibiting a combination of solvent actions to dissolve both water-soluble and water-insoluble dirt accumulations and leave the metal surfaces in a bright, polished and clean condition with the use of a wiping action. Basically the compositions contain a low molecular weight chlorinated hydrocarbon solvent and a sufficient amount of an amine soap of a long-chain fatty acid to form a clear aqueous solution with or without certain co-solvents such as butoxyethanol, soluble in both the aqueous and non-aqueous phases, and selected optical brighteners and streak-reducing agents. An illustrative composition contains about 9% to 12% by weight of the chlorinated solvent, 3% to 6% by weight of the fatty acid, 3% to 5% by weight of the amine, 25% to 30% by weight of a water-soluble alkyl glycol ether with the balance being water. Other embodiments are disclosed.

7 Claims, No Drawings

STAINLESS STEEL CLEANER

BACKGROUND OF THE INVENTION

It is known to incorporate trace amounts of soaps in dry cleaning solutions along with minimum amounts of water. In U.S. Pat. No. 3,701,627 by Grunewalder, there is disclosed a process for cleaning soiled textiles by treatment with a clear water-containing organic solvent mixture of 20% to 40% by volume of a halogenated hydrocarbon having from 1 to 2 carbon atoms, from 55% to 70% by volume of a monohydric alcohol having from 2 to 5 carbon atoms, such as alkanols and ethylene glycol monoalkyl ethers, and 5% to 12% by volume of water. Compositions of this nature are unsuitable for using in cleaning metal surfaces, such as stainless steel, because of their inherent lack of solution stability and their inability to solubilize or suspend the various kinds of stains, dirt and other materials which accumulate on the metal surfaces in the presence of heat, fumes, boiling solutions and corrosive gases that are associated with restaurants, kitchens and laboratories. A large number of commercially available metal cleaning compositions were evaluated and found to be deficient in that the residual film, if any, left after cleaning, attracted dirt and increased the number of cleaning cycles necessary to maintain the sinks, cabinets and related stainless steel parts in acceptable condition. Furthermore, the compositions tested exhibited the tendency to leave visible streaks and as a result required special attention in order to leave a satisfactorily cleaned surface. There was little, if any, evidence that the compositions were capable of leaving a polished surface of lasting quality. Other compositions required an inordinate amount of hand pressure to accomplish a cleaning action and still others contained odorous or toxic materials and showed too high a flammability rating to be acceptable under the present or future Environmental Protection Agency standards. A common fault of the commercial solutions was lack of homogenity and the appearance of some products left much to be desired from a sales standpoint.

SUMMARY OF THE INVENTION

This invention has as its primary objective the provision of cleaning compositions which overcome or mitigate the disadvantages found and generally known to exist in existing prior art compositions. Briefly it was found that the water-solubilization of chlorinated solvents with a fatty acid-amine soap, prepared from commercially available materials, produced a basic solution which not only overcomes the aforesaid disadvantages but lends itself readily to the incorporation of such other solvents as butoxyethanol and ethoxyethanol, isopropanol and tripropylene glycolmonoether, which exhibit combined solubility in the water and organic phases for enhanced solvent and cleaning action. There are other materials having detergent properties, like the quaternary ammonium compounds and certain nonionic materials that can be used to water-solubilize chlorinated solvents. However, their use reduced the cleaning action and they were effective only at high concentrations. In accordance with this invention, the use of fatty acid-amine soaps not only quite effectively solubilizes the chlorinated hydrocarbon solvents in water, such soaps also allow and are compatible with the use of certain other solvents or co-solvents and polishes to form cleaning compositions of highly acceptable stability, clarity and versatile cleaning and polishing action.

The fatty acid-amine soaps were found to bring the ingredients into a homogeneous stable blend that was highly suitable for the intended purposes.

DESCRIPTION OF THE PREFERRED EMBODIMENTS

In order to demonstrate the invention, a number of specific examples are given, part of which illustrate compositions which failed in one or more respects as far as stability, clarity, and cleaning or polishing action were concerned.

A series of commercially available stainless steel cleaning compositions, containing and not containing a finely divided abrasive such as pumice, grit and metal oxides such as jewelers rouge, are tested to determine their standards of performance. In each instance the directions on the containers are followed exactly and the soiled conditions of the stainless steel counters, sinks and the like are the result of ordinary usage as would occur in a restaurant, home or laboratory. The stainless steel is the 18% Cr-8% Ni variety.

In general, these compositions show a number of disadvantages including incomplete or uneven cleaning, the necessity for hard rubbing during application, and the existence of a hazy film or residue as well as streaks which cannot be flushed away with water. Some of the cleaners do not improve in performance when repeated applications are tried and there does not appear to be any polishing or brightening action even after vigorous or repeated application. Furthermore, the cleaned stainless steel surfaces exhibit a propensity for quickly accumulating grease residues and dirt as well as stains when again subjected to normal use. The presence of a hazy, dull film which attracted rather then repelled stains, dirt and grease was determined to be one of the primary disadvantages of the available cleaners, along with the necessity for hard rubbing to attain anything resembling desirable results.

EXAMPLE 1

A stainless steel cleaning composition containing

| Ingredient | Wt.% |
|---|---|
| Methyl chloroform | 10.0 |
| Oleic acid | 5.5 |
| Triethanolamine | 4.5 |
| Tridecanol (Neodol) | 8.0 |
| Tripropylglycolmethyl ether | 26.0 |
| Water (q.s. to) | 100.0 |
| Optical brightener | 0.1 |
| Color | trace |

was prepared by adding the oleic acid and the triethanolamine to the methyl chloroform with agitation at room temperature until a clear solution was attained. The tridecanol and tripropylglycolmethyl ether, optical brightener and dye are added with sufficient water to bring the composition to 100%, namely about 45.9 wt.%. The optical brightener was the proprietary product of American Cyanamid Co. known commercially as "Calcofluor White M-2-R" and the coloring agent was Brilliant Blue No. 1.

The formulation of Example 1 was clear and storage stable over extended periods of time. A soft, clean cloth was moistened with the solution and applied evenly to a badly soiled and stained stainless steel (18%Cr-8%Ni) surface. Slightly more rubbing pressure was applied to the more badly stained areas and the entire surface was wiped clean without rinsing. No greasy film remained and the surface exhibited a water repellant shine. The surface did not show fingerprints on touching. After exposing the surface to fruit juices, greasy dishwater and other dirty soap and detergent solutions, periodically for a number of days, the luster remained and the steel surface showed little tendency to build up an unsightly residue. The cleaned surfaces were notable because of the absence of streaks which were unavoidable with the prior art compositions.

EXAMPLE 2

A cleaning composition containing

| Ingredient | Wt.% |
|---|---|
| Methyl chloroform | 9.0 |
| Oleic acid | 4.0 |
| Triethanolamine | 3.0 |
| Water | 84.0 |

is prepared by adding the oleic acid and the triethanolamine to the methylchloroform with agitation at room temperature until a clear solution is obtained. Then the water is added, again with agitation and the solution is clear and entirely homogeneous.

The cleaning composition is used on badly stained and dirty stainless steel, as in Example 1. On being wiped with a soft rag moistened with the composition and flushed with water the surface is essentially clean and stain-free but will lack some luster and reflectivity. Small areas may remain which require more cleaning action. The use of an excess of this composition, followed by removal of the semi-wet residue, will produce an essentially clean surface but again without high luster and reflectivity. No areas will, however, appear which need more cleaning action with this type of application. Vigorous rubbing with the composition produces a clean surface and which exhibits somewhat more luster.

EXAMPLE 3

A cleaning composition containing

| Ingredient | Wt.% |
|---|---|
| Methylchloroform | 9.0 |
| Oleic acid | 4.0 |
| Triethanolamine | 3.0 |
| Butoxyethanol | 20.0 |
| Water | 64.0 |

is prepared as in Example 1 with the water and butoxyethanol being added after the fatty acid-amine soap formation in methylchloroform. A clear stable solution results. Upon testing this composition, as in Example 1, the stainless steel is satisfactorily cleaned. There is essentially no streaking on all of the portions of the stainless steel so treated and the surfaces do not show fingerprints on handling. Build-up of new residues during ordinary use is retarded.

EXAMPLE 4

A cleaning composition having the following ingredients is formulated following the procedure of Example 3:

| Ingredient | Wt.% |
|---|---|
| Methylchloroform | 9.0 |
| Oleic acid | 3.0 |
| Triethanolamine | 3.0 |

-continued

| Ingredient | Wt.% |
|---|---|
| Butoxyethanol | 25.0 |
| Water | 60.0 |

This composition, upon being tested in accordance with the procedure of Example 1, will show in each instance that the test metal surfaces are quite clean and essentially streak-free, but the time required to complete the cleaning operation is somewhat extended. However, the reflectivity of the test panels, as well as their tendency to show streaks, is acceptable.

EXAMPLE 5

A cleaning composition having the following ingredients is formulated following the procedure of Example 3:

| Ingredient | Wt.% |
|---|---|
| Methylchloroform | 10.0 |
| Oleic acid | 4.0 |
| Triethanolamine | 4.0 |
| Butoxyethanol | 27.0 |
| Water | 55.0 |

The above formulation is clear and storage stable. A soft, clean cloth is moistened with the solution and applied evenly to a badly soiled and stained piece of stainless steel (18% Cr.-8% Ni). Slightly more rubbing pressure is applied to the stained areas. No rinsing or air-drying steps are applied. The steel exhibits no greasy film and has a water repellent shine, nor does it show fingerprints on handling. After exposing the surface to fruit juices, dish water, boiling water from the cooking of vegetables and various dirty, soapy water solutions, periodically for a number of days, the luster remains and the steel surface does not build up an unsightly residue.

The following additional examples illustrate specific compositions with various ingredients falling within the class of materials and proportions hereinafter set forth.

EXAMPLE 6

| Ingredient | Wt.% |
|---|---|
| Ethylenedichloride | 12.0 |
| Stearic acid | 6.0 |
| Diethanolamine | 5.5 |
| Butoxyethoxyethanol | 26.0 |
| Tridiamol | 8.0 |
| Optical brightener | 0.2 |
| Color | trace |
| Water | 42.3 |

EXAMPLE 7

| Ingredient | Wt.% |
|---|---|
| Tetrachloroethylene | 10.0 |
| Isostearic acid | 5.5 |
| Dilsopropanolamine | 4.5 |
| Dodecyl alcohol | 9.0 |
| Tripropyleneglycolmethyl ether | 25.0 |
| Water | 46.0 |

EXAMPLE 8

| Ingredient | Wt.% |
|---|---|
| Trichloroethylene | 10.0 |
| Ricinoleic acid | 6.0 |
| Triethanolamine | 4.0 |
| Decylalcohol | 7.5 |
| Butoxyethanol | 24.0 |
| Water | 48.5 |

EXAMPLE 9

| Ingredient | Wt.% |
|---|---|
| Methylchloroform | 10.0 |
| Abietic acid from tall oil | 5.5 |
| Triethanolamine | 4.8 |
| Tridecanol | 8.5 |
| Butoxyethoxyethanol | 27.0 |
| Optical brightener | 0.2 |
| Color | trace |
| Water | 44.0 |

The aliphatic polyhalogen compounds used as solvents in accordance with this invention are normally liquid, inert, non-inflammable and non-corrosive to metals in the presence of water, such as, the saturated and unsaturated $C_2$ hydrocarbons (ethane and ethylene) having from 2 to 4 atoms of chlorine or bromine, including ethylene dichloride, ethylene dibromide, ethylidene chloride, ethylidene bromide, methylchloroform, tetrachloroethylene, also known as "Perclene", unsym-trichloroethane, and ethylenedichloride. The preferred solvents are trichloroethylene, methylchloroform and tetrachloroethylene. About 9% to 12% by weight of the aliphatic polyhalogen compound is used in the composition of this invention.

The fatty acid used to prepare the amine soap can be any saturated or unsaturated long chain mono- or dicarboxylic acid having 12 to 18 carbon atoms to the molecule such as the following species:

Saturated fatty acids

Lauric
Myristic
Palmitic
Stearic
Isostearic

Unsaturated fatty acids

Dodecylenic
Palmitoleic
Oleic
Ricinoleic
Linoleic
Abietic acid (as in Tall Oil)
Linolenic Of the foregoing, oleic, abietic, stearic and isostearic acids are preferred. A stoichrometric amount ranging from about 3% to 6.0% by weight of fatty acid is used.

The amines used to prepare the soaps by reaction in situ with one or more of the foregoing fatty acids include:

Monoethanolamine
Diethanolamine
2-(2-aminoethylaminoethanol)
2-butylaminoethanol
2-diethylaminoethanol
2-dimethylaminoethanol
2-ethylaminoethanol
2-isobutylaminoethanol
2-isopropylaminoethanol
2-methylaminoethanol butyldiethyl 2'2''-dihydroxyamine
Triethanolamine
2,2'-dihydroxy-butylethylamine
3,2'-dihydroxy-butylethylamine
3,3'-dihydroxy di-sec-butylamine
Diisopropanolamine
2,2'2''-trihydroxy triethylamine (triethanolamine)
2,2'2''-trihydroxy triethylamine (triisopropanolamine)

Again a stoichoimetric amount ranging from about 3% to 5% by weight of the amine is used, sufficient to react with the acid present.

The solvent and cleaning action of the water-solubilized chlorinated hydrocarbon solvent can be further enhanced by the presence of several other co-solvents, the more effective being the alkyl ethers of ethyleneglycol (marketed by Carbide & Carbon Chemicals Co. under the trademark "CELLOSOLVE" and known as ethyl Cellosolve) and of diethyleneglycol (marketed by Carbide & Carbon Chemicals. Co. under the trademark "CARBITOL") as well as of tripropylene glycol. The preferred being butoxyethanol (butyl cellosolve) butoxyethoxyethanol, and tripropylene glycol methyl ether (also known commercially as "TPM".

Preferrably the co-solvent is tripropylene glycol methyl ether (TPM) and butoxyethanol. The alkyl glycol ethers or the alkoxyethanol such as the "Carbitols" (alkyl diethylene glycol ethers or alkoxy-ethoxyethanol as well as other glycol ethers) are preferrably completely water-soluble or essentially water-soluble for best co-solvent results. Other species include methyl cellosolve, isobutyl cellosolve, as well as mixtures thereof with any of the foregoing. Generally about 25% to 30% by weight of the co-solvent is sufficient.

It is advantageous from purely aesthetic and identification viewpoints to incorporate any one of several dyes in the compositions of this invention. For this purpose such dyes as Brilliant Blue No. 1 and like dyes, so-called "D and C" dyes, approved by the Food and Drug Administration can be used. Other materials to impart colors can be used. Small amounts, in the order of 0.001% by weight to 0.01% by weight of the dyes are sufficient for this purpose. Since this ingredient is well known and not essential, no further description is necessary.

In addition, a number of optical brighteners can be included in the formulation such as benzophenone compounds and such as the proprietary product of American Cyanamid Co., known commercially as "Calcofluor White M-2-R". This proprietary product is 4,4'-Bis((4-anilino-6-[bis(2-hydroxyethyl)anino]-s-triazin-2-yl)amino)-2,2'-stilbenedisulfonic Acid. Generally only about 0.02% to 0.20% by weight of an optical brightener is necessary.

In accordance with one aspect of this invention, about 5% to 15% by weight of an anti-streaking agent such as high molecular weight non-volatile long chained ($C_{10}$ to $C_{14}$) alcohols or pine oil are included in the formulation to reduce streaking on polished stainless steel. Other specific examples of $C_{10}$–$C_{14}$ alcohols suitable for this purpose are decylalcohol, undecylalcohol, dodecylalcohol, and myristylalcohol. A preferred non-streaking agent is a proprietary product of the Shell Oil Company, known under the trademark NEODOL which is essentially tridecyl alcohol.

The compositions of this invention are stable, essentially non-corrosive, clear liquids that can be packaged in bottles or cans. In the event packaging in Aerosol containers is used, about 0.2% by weight of a corrosion inhibitor such as sodium nitrite is incorporated. Storage tests on the product in cans under accelerated conditions show that the products can be stored for 6 months or more.

Accordingly in view of the foregoing disclosure the cleaning compositions of this invention for use in cleaning stainless steel consist essentially of about 9 to 12% by weight of a halogenated $C_2$ hydrocarbon having 2 to 4 carbon atoms of a halogen such as chlorine and bromine per molecule; about 3% to 6% by weight of a $C_{10}$ to $C_{20}$ fatty acid; about 3% to 5% by weight of an alkanol amine having 2 to 12 carbon atoms and 1 to 2 amino groups per molecule; about 25% to 30% by weight of a water-soluble $C_1$ to $C_4$ alkyl glycol ether, such as the alkyl ethers of ethylene glycol, the alkyl ethers of diethylene glycol and the alkyl ethers of tripropylene glycol and the balance being water. In one embodiment about 5% to 15% by wt. of a non-volatile hydrocarbon having from 10 to 14 carbon atoms per molecule is included as an anti-streaking agent. The compositions are stable, clear and non-flammable.

What is claimed is:

1. A cleaning composition for stainless steel consisting essentially of about 9% to 12% by weight of a halogenated $C_2$ hydrocarbon having 2 to 4 atoms of a halogen of the group consisting of chlorine and bromine per molecule;
   about 3% to 6% by weight of a fatty acid having 10 to 20 carbon atoms per molecule;
   about 3% to 5% by weight of an alkanol amine having 2 to 12 carbon atoms and 1 to 2 amino groups per molecule;
   about 25% to 30% by weight of a water-soluble $C_1$ to $C_4$ alkyl glycol ether; and
   the balance of the composition being water;
   said composition being a stable, clear non-flammable solution.

2. A cleaning composition in accordance with claim 1 in which:
   said halogenated $C_2$-hydrocarbon is methylchloroform;
   said fatty acid is oleic acid;
   said alkanol amine is triethanolamine; and
   said alkyl glycol ether is butoxyethanol.

3. A cleaning composition in accordance with claim 1 containing:
   about 5% to 15% by weight of a non-volatile hydrocarbon alcohol having from 10 to 14 carbon atoms per molecule as an anti-streaking agent.

4. A cleaning composition for stainless steel consisting essentially of:
   about 9% to 12% by weight of a halogenated $C_2$ hydrocarbon having 2 to 4 atoms of a halogen of the group consisting of chlorine and bromine per molecule;
   about 3% to 6% by weight of a fatty acid having 10 to 20 carbon atoms per molecule;
   about 3% to 5% by weight of an alkanol amine having 2 to 12 carbon atoms and 1 to 2 amino groups per molecule;
   about 25% to 30% by weight of a water soluble $C_1$ to $C_4$ - alkyl glycol ether;
   about 5% to 15% by weight of a non-volatile hydrocarbon alcohol having from 10 to 14 carbon atoms per molecule as an anti-streaking agent; and
   the balance of the composition being water.

5. A cleaning composition in accordance with claim 4 in which:
   said halogenated $C_2$-hydrocarbon is methylchloroform;
   said fatty acid is oleic acid;
   said alkanol amine is triethanolamine; and
   said alkoxy alkanol is butoxyethanol.

6. A stainless steel cleaning composition consisting essentially of:
   about 9% to 12% by weight of methylchloroform;
   about 3% to 6% by weight of oleic acid;
   about 3% to 5% by weight of triethanolamine; about 25% to 30% by weight of butoxy ethanol;
   about 5% to 15% by weight of tridecanol; and
   water making up the balance of the composition.

7. A stainless steel cleaning composition consisting essentially of:
   about 10% by weight of methylchloroform;
   about 5.5% by weight of oleic acid;
   about 4.5% by weight of triethanolamine;
   about 5% to 15% by weight of tridecanol;
   about 26% by weight of tripropylene glycol methyl ether; with the balance of the composition being water.

* * * * *